US008820328B2

(12) United States Patent
Ehling et al.

(10) Patent No.: US 8,820,328 B2
(45) Date of Patent: Sep. 2, 2014

(54) DEFIBRATION OF TOBACCO MATERIAL

(75) Inventors: Uwe Werner Ehling, Goldkronach (DE); Gerald Schmekel, Elmshorn (DE); Dietmar Franke, Bayreuth (DE); Matthias Link, Bayreuth (DE)

(73) Assignee: British American Tobacco (Germany) GmbH, Hamburg (DE)

( * ) Notice: Subject to any disclaimer, the term of this patent is extended or adjusted under 35 U.S.C. 154(b) by 916 days.

(21) Appl. No.: 12/977,569

(22) Filed: Dec. 23, 2010

(65) Prior Publication Data

US 2011/0088705 A1 Apr. 21, 2011

Related U.S. Application Data

(62) Division of application No. 11/792,573, filed as application No. PCT/EP2005/012687 on Nov. 28, 2005, now Pat. No. 7,934,509.

(30) Foreign Application Priority Data

Dec. 9, 2004 (DE) ..... 10 2004 059 388
Dec. 21, 2004 (DE) ..... 20 2004 019 711 U

(51) Int. Cl.
*A24B 7/14* (2006.01)
*A24B 3/10* (2006.01)
*A24B 3/18* (2006.01)

(52) U.S. Cl.
CPC ..... *A24B 3/18* (2013.01)
USPC ..... 131/108; 131/290; 131/313

(58) Field of Classification Search
USPC ..... 131/108, 290, 297, 298, 313, 317, 327, 131/375
See application file for complete search history.

(56) References Cited

U.S. PATENT DOCUMENTS 3,098,492 A 7/1963 Wurzburg et al.
3,612,066 A 10/1971 Jones et al.
(Continued)

FOREIGN PATENT DOCUMENTS

DE 2002004019711 U1 4/2005
EP 0647102 A1 4/1995
(Continued)

OTHER PUBLICATIONS

U.S. Patent and Trademark Office(SA/US); International Search Report; Feb. 13, 2006; pp. 103; U.S. Patent and Trademark Office; U.S.

*Primary Examiner* — Sing P Chan
(74) *Attorney, Agent, or Firm* — Middleton Reutlinger; Charles I. Sherman; John F. Salazar

(57) ABSTRACT

The invention relates to a method of producing cut tobacco material, whereby a tobacco initial material is heated and placed under pressure and once heated and placed under pressure, the material is fed through a shearing gap and expanded and defibrated. It further relates to a device for producing cut tobacco material with a pressure chamber, which has a tobacco material inlet at the low-pressure end and a tobacco material outlet at the pressure end and a conveyor system for conveying the tobacco material from the inlet to the outlet, and the tobacco material outlet has a gap through which the material passes and expands, and the gap has walls which can be moved towards one another. It further relates to a smoking article containing such a cut, defibrated tobacco material product and the use of a plug screw feeder-extruder with a shearing gap outlet for defibrating tobacco material.

22 Claims, 5 Drawing Sheets

(56) References Cited

U.S. PATENT DOCUMENTS

| | | | | | |
|---|---|---|---|---|---|
| 3,894,544 | A * | 7/1975 | Egri | 131/370 |
| 4,083,371 | A | 4/1978 | Beringer et al. | |
| 4,696,311 | A * | 9/1987 | Chard et al. | 131/109.1 |
| 4,922,932 | A * | 5/1990 | Williams et al. | 131/290 |
| 5,076,293 | A | 12/1991 | Kramer | |
| 5,323,791 | A | 6/1994 | Wu et al. | |
| 5,367,578 | A * | 11/1994 | Golem et al. | 382/183 |
| 5,478,511 | A | 12/1995 | Forseman | |
| 7,380,554 | B2 | 6/2008 | Ehling et al. | |
| 7,387,128 | B2 | 6/2008 | Ehling et al. | |
| 7,934,509 | B2 * | 5/2011 | Ehling et al. | 131/297 |
| 8,443,813 | B2 * | 5/2013 | Boldrini | 131/375 |
| 2004/0216751 | A1 * | 11/2004 | Mengoli et al. | 131/108 |
| 2004/0216752 | A1 * | 11/2004 | Mengoli et al. | 131/109.1 |
| 2005/0109354 | A1 * | 5/2005 | Draghetti | 131/108 |
| 2008/0142027 | A1 * | 6/2008 | Ehling et al. | 131/281 |
| 2011/0088705 | A1 * | 4/2011 | Ehling et al. | 131/108 |
| 2011/0309559 | A1 * | 12/2011 | Franke et al. | 264/571 |

FOREIGN PATENT DOCUMENTS

| | | | |
|---|---|---|---|
| EP | 1444905 | A2 | 8/2004 |
| GB | 579029 | A * | 7/1946 |
| JP | 62055038 | | 3/1987 |
| JP | 9163966 | A | 6/1997 |
| WO | 9401007 | A1 | 1/1994 |
| WO | 2006061117 | A1 | 6/2006 |

* cited by examiner

DEFIBRATION OF TOBACCO MATERIAL

CROSS REFERENCE TO PRIOR APPLICATION

This divisional patent application claims priority to and benefit from, currently pending, U.S. patent application Ser. No. 11/792,573, having a filing date of Jun. 7, 2007, which is a national stage filing (35 U.S.C. 371) of PCT/EP2005/012687, filed on Nov. 28, 2005, which claims priority to and benefit from German Patent Application DE 20 2004 019 711.1, filed on Dec. 21, 2004 and claims priority to and benefit from German Patent Application DE 10 2004 059 388.4, filed on Dec. 9, 2004.

The present invention relates to the defibration of tobacco material. In particular, it relates to the production of tobacco material cut by defibration, and especially the fact that a tobacco stem material is defibrated in such a way as a result of the invention that a product with particularly advantageous properties is produced, which can ultimately be used for the production of smoking articles.

During tobacco processing, i.e. during those processing operations which take place prior to producing the actual cigarettes and packaging, the most important tobacco materials, namely tobacco leaves (lamina) and tobacco ribs (stems) are subjected to several process steps before they can be used to produce smoking articles. These smoking articles might be cigarettes, cigarillos, rolling and stick products as well as fine-cut tobacco or pipe tobacco. At least a certain proportion of tobacco stems may also be used in all of these smoking articles.

Said tobacco stems may be whole tobacco stems, which will also be referred to as raw stems below, or incompletely defibrated raw stems, which will also be referred to as winnowings. Winnowings are coarsely cut stem particles, which as a rule have been sorted and removed from already cut tobacco because they are undesirable in smoking articles due to their size and shape and would impair the quality of the smoking articles. A further distinction is made between winnowings from cigarette production (CPP-winnowings=winnowings from cigarette production/packaging) and those from tobacco processing (TP-Winnowings). Winnowings are usually recycled or disposed of as a waste product.

Conventional stem cutting processes, using cutters or shredders for example, represent a major challenge for the tobacco processing operation. The stem material must be moistened through to the core to relatively high moisture levels of 30 to 50% for these processes in order to guarantee an optimum cutting result without too high a material loss due to tobacco dust. Expansion processes connected downstream also often require as high as possible moisture contents at the intake in order to increase packing capacity. Since the stem material can only be conditioned uniformly (heating, cooling, drying and moistening) with great difficulty due to its coarse properties (woody and with a material thickness of 1 to approximately 15 mm), most conditioning processes involve very long dwell times. This applies in particular to the moistening process, which even requires the moistened material to be temporarily stored for what is usually 2 to 6 hours to ensure that the moisture has penetrated the interior of the material. Even two-stage moistening processes are used. The high degree to which moistening is needed for the described conventional processes is associated with another major disadvantage, namely the need to dry the cut tobacco materials, because such drying processes incur high energy and equipment costs.

The process using stem shredders, in addition to requiring a very high moisture level of approximately 40 to 45% during processing for example, has another major disadvantage in that the shredded material contains too many small parts (fines), namely ca. 15 to 30%, depending on how the process is implemented, which have to be sifted out and either disposed of or processed to a film and then recycled. Some other processes are also beset by the same problem, for example if using mills to cut the stems.

Other stem processing operations process the stems to tobacco films, which are then blended with a leaf tobacco mixture. To this end, the stems are firstly cut into fines. Such methods of producing tobacco films are known from patent specifications DE 40 05 656 C2 and DE 43 25 497 A1, for example. The tobacco film processes are operated using additives such as binding agents (e.g. starch), moisture retaining agents (e.g. glycerine) and other additives (e.g. flavour enhancers), and, depending on the process, result in a product with moderate to poor packing capacity and sensory deficiencies compared with leaf tobacco.

Patent specification DE 100 65 132 A1 discloses a method of producing agglomerates. It proposes making agglomerates from the smallest tobacco particles, in particular from tobacco dust, in other words larger particle complexes which do not have to be separated out from a cigarette production machine as this is not desirable.

As with the method mentioned above, the finest tobacco dust particles are mixed with bindings agents and liquid and then sprayed out of compaction and heating chambers in order to form agglomerates, in other words the bigger units. The same problems of using binding agents as those described above occur. Another disadvantage is the fact that such a process is already not suitable for processing coarser tobacco material in principle because it is designed to produce larger agglomerates from small particles. It is not possible to cut tobacco material using this process.

The objective of the present invention is to enable the production of cut tobacco material without encountering the disadvantages outlined above. In particular, the invention should make it possible to manufacture a tobacco product which is suitable for immediate use as smoking article material or which requires only little subsequent processing. The time and complexity involved in processing should also be reduced.

This objective is achieved by the invention on the basis of a method as defined in claim 1. The dependent claims describe advantageous embodiments of the invention.

Amongst others, the invention defined above offers the following advantages. The stem materials used are subjected to an upgrading process evaluated so that the resultant product has only slight sensory deficiencies compared with leaf tobacco and can therefore be used to a greater extent in the tobacco blend of a smoking article. The resultant product has a well defibrated and cut structure and is therefore barely visually perceptible in cut tobacco blends. The process sequences are simple and uncomplicated, which leads to low investment and production costs. The space required for the devices to be used is very small due to the low complexity of the method. Defibration produces a product which can lead to a reduced CO/condensate ratio in the cigarette smoke compared with stem products processed in other ways. The invention enables continuous processing within very short periods; long storage time are avoided.

The advantages of the method proposed by the invention are attributable in particular to the combined operation of expanding the tobacco material placed under pressure and heated and shearing it through the gap, which all in all results in a very good defibration. As far as the device proposed by the invention is concerned, its advantages are specifically based on the fact that the optimally defibrated product can be produced due to the gap walls moving towards one another with a high degree of constancy and reliability. The product which can be produced as a result of the invention also has the advantages mentioned above of packing capacity, which is in the range of leaf tobacco, and enables a high material yield; few fines are produced. Storage times for tobacco stem material are significantly reduced or superfluous.

The method proposed by the invention may be implemented in the following different ways.

The tobacco initial material may largely be a coarse tobacco material, in particular with a particle size of more than 2 mm. It may be a tobacco stem material or a winnowing material, in particular with a stem size of more than 2 mm. In this respect, it should be noted that tobacco materials such as raw stems, winnowings, short stems or stem fibres but also scraps (small leaf tobacco particles), other tobacco small particles or a mixture of said components may be used.

By contrast with the process of producing films, the method proposed by the invention offers the possibility of processing the tobacco materials so that they can be used in the smoking article without adding structure-imparting materials to a product.

The tobacco initial material may be heated to a temperature of 60° to 180° C., in particular 100° to 140° C., preferably 110° to 130° C., and brought to a pressure of 10 to 200 bar, in particular 40 to 150 bar, preferably 60 to 120 bar, and the dwell time of the tobacco material through the continuous circulation may be less than 3 minutes, in particular less than 2 minutes and preferably less than 1 minute.

The tobacco initial material is preferably placed under pressure mechanically, in particular mechanically pressed against the shearing gap in a chamber. This being the case, the material may be placed under pressure by means of a conveyor screw, which presses the material towards the outlet end of the chamber of a heatable screw conveyor, at which the shearing gap is disposed. The material may also be coarsely pre-cut or coarsely pre-defibrated in the chamber or screw conveyor as it is fed towards the shearing gap.

In one embodiment, the shearing gap is closed under pretensioning and is intermittently opened by the pressure of the tobacco material so that the material passes through the gap. Alternatively, the material may also advantageously be fed through a continuously opened shearing gap.

The shearing gap walls may effect a relative movement as the tobacco material is fed through and may also do so with a gap distance which remains constant, i.e. continuous gap opening. The tobacco material expands to atmospheric pressure as it passes through the shearing gap in one embodiment. Before or during heating and generating the pressure, a tobacco material conditioning process with or without casing and/or the addition of flavouring may take place, in which case the material moisture is increased from approximately 9 to 12% to approximately 18 to 45%, in particular 20 to 30%. Having expanded and passed through the shearing gap, the tobacco material has a moisture content of approximately 14 to 42%, preferably 16 to 18% in one embodiment, and there is the option of cooling the tobacco material at room temperature and atmospheric pressure after the shearing gap and thus drying it or allowing it to dry until it has a moisture content of approximately 12 to 16%.

The cut, pressure-defibrated tobacco material produced by the method proposed by the invention may be used directly for further processing as smoking article material if the tobacco initial material is a winnowing material or if sufficiently pre-cut material is used. Alternatively, the cut, pressure-defibrated tobacco material may be subjected to a classification following the method proposed by the invention, e.g. if the initial material is a very coarse stem material. In a preferred embodiment in this instance, materials that are too coarse separated out during the classification may be returned to the process again and the remainder that is not separated out can be forwarded directly for further use as smoking article material.

The device proposed by the invention may be configured as in the following embodiments.

The gap walls of the device can be moved apart from one another and towards one another; the gap walls can be biased towards the state in which the gap is closed. Alternatively, the gap walls may be moved towards one another with a fixed or fixedly adjustable distance, in which case the gap walls lie at a fixed distance of 0.01 mm to 2 mm, in particular 0.1 mm to 0.5 mm. These figures relate to smooth gap walls.

In a preferred embodiment, the gap walls have roughening or profiling, in particular grooved or intersecting grooved profiling, disposed longitudinally or transversely to the direction in which the gap wall moves and are of a depth of up to 2 to 3 mm. In the deep regions of the profiling, the distances are naturally correspondingly longer than as specified above.

In one embodiment, the gap wall disposed on the pressure chamber is stationary whereas the co-operating wall can be displaced on a co-operating holder provided with a displacement drive. The gap walls may be moved towards one another continuously or intermittently or in one or two directions or backwards and forwards. In particular, the gap may be an annular gap, preferably a conical gap.

In one embodiment of the invention, the pressure chamber has a conveyor system in the form of a plug screw feeder for conveying the tobacco material from the inlet to the outlet. In this respect, it should be pointed out that pressure is generated by mechanical means, such as generated by a plug screw feeder for example, although other systems may also be used in principle within the context of the invention. Generating the pressure by some other mechanical means is not ruled out, for example by means of a piston system or alternatively, not mechanically or not only mechanically by means of a gas pressure.

If a plug screw feeder is used, it advantageously has reducing features which reduce the chamber volume in the region towards the outlet, e.g. smaller screw pitches.

Mechanical pre-cutting means or pre-defibrating means are advantageously disposed in the pressure chamber. In one advantageous embodiment, a screw chamber pressure-conditioning device is disposed upstream of the device proposed by the invention in the same pressure chamber housing or in another one connected upstream. A pressure conditioning device of this type is described in patent DE 103 04 629 A1, for example, and lends itself very well to a combination with the pressure defibration system proposed by the invention. The pressure conditioning system may incorporate all the structural features illustrated in FIG. 1 and explained in the associated description of DE 103 04 629 A1 and reference may be made to these construction features for further details.

Another option is to equip the pressure chamber with inlets for conditioning agents or casing agents and flavourings.

The smoking article proposed by the invention comprises a cut, defibrated tobacco material product, which is produced by one of the methods outlined above or with one of the devices described above. It may contain the tobacco material product in a proportion of up to 50%, in particular from 0.5% to 35% and particularly preferably from 0.5% to 25%.

The invention further relates to the use of a single or twin screw conveyor with a shearing gap outlet for defibrating tobacco material. The expression shearing gap within the meaning of this invention should be construed as meaning an orifice, through which the material is sheared as it passes through. Until now, extruders have only ever been used to produce tobacco film or to produce agglomerates from the finest tobacco particles. The present invention describes a use of an extruder with a shearing gap to cut and defibrate tobacco materials for the first time.

In the context of the use proposed by the invention, the method proposed by the invention can be implemented in all method variants and the device proposed by the invention may be used in all embodiments.

The invention will be explained in more detail below with reference to embodiments. They may incorporate all the described features individually and in any combination. Reference will be made to the appended drawings. Of these:

Firstly, a more detailed description will be given below of how the pressure defibration system proposed by the invention fits into the tobacco preparation process with reference to FIGS. 1 and 2.

Figure 1:
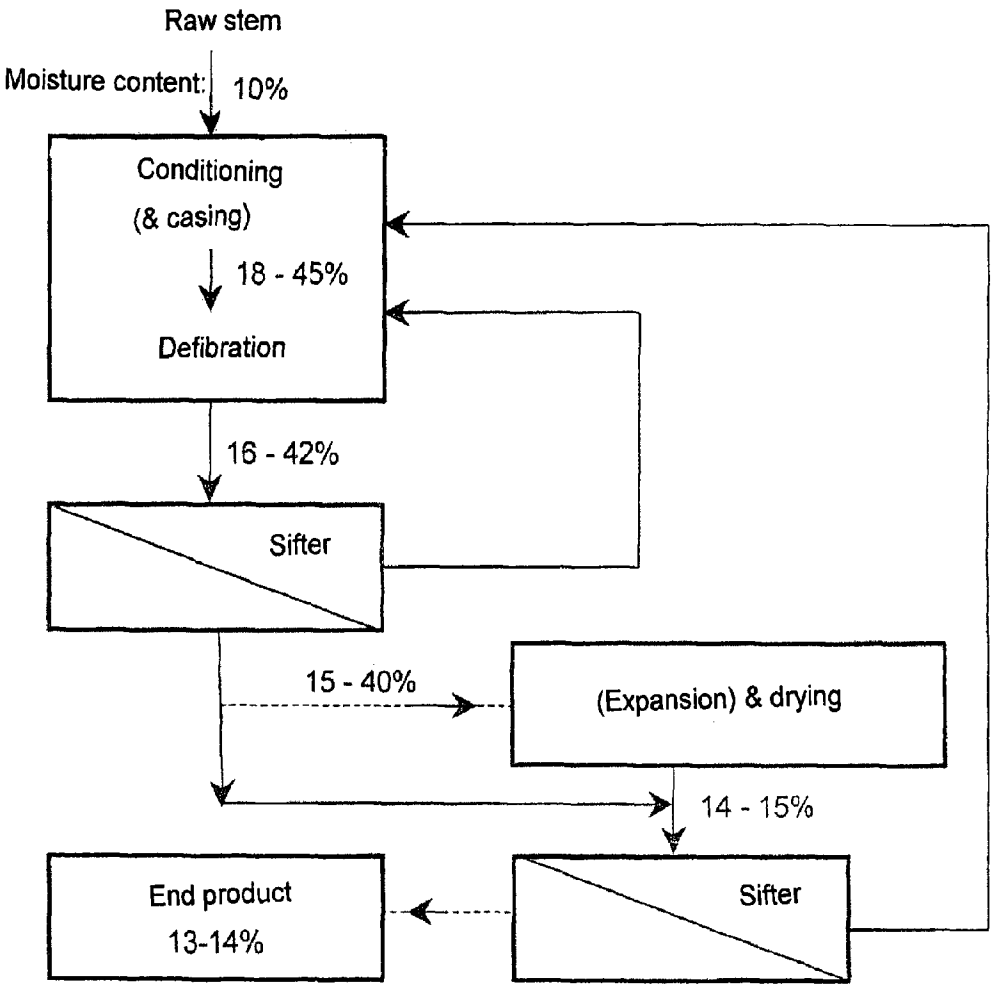
FIG. 1 is a flow chart, schematically illustrating the sequence used to process tobacco using the pressure defibration system proposed by the invention.

Generally speaking, the sequence illustrated in FIG. 1 shows the preparation of tobacco from stems from the raw stem for use in the end product.

The specified moisture values are based on moisture and represent recommended and preferred values. Persons skilled in the art will be able to set up optimum conditions if they follow the underlying principle of the invention and thus adapt a specific device (expansion plant) proposed by the invention to optimum conditions.

The raw stems typically enter the conditioning system with a moisture content of approximately 10%. Conditioning may take place under atmospheric conditions but it is of advantage to operate the conditioning process at a pressure above atmospheric pressure, as described in patent specification DE 103 04 629 A1 mentioned above. During conditioning and essentially simultaneously during the process (atmospheric or above atmospheric pressure), casing and flavouring agents may be added, in a manner known to those skilled in the art. The stems leave the conditioning process with a moisture content of approximately 18% to 45% and are transferred to the defibration system proposed by the invention. Details of the defibration system will be given below with reference to embodiments illustrated in FIGS. 3 to 5.

The stems lose some moisture during defibration as a rule and the cut stems are now classified as having a moisture content of 16% to 42%. At this stage, stem parts that are too big are conveyed out and fed back through the sequence described so far. This percentage is typically low and is less than 10% of the total quantity. The other proportion of cut stems can now be processed in different ways, depending on the desired process parameters. At moisture levels of 14% to 15%, for example, the stems are sent directly to the tobacco blending system for the smoking article end product. At higher moisture levels of 15% to 40%, for example, the stems still have to be fed through an expansion and drying process, after which they will also have a moisture content of 14% to 15% and can be added to the mixture for the end product. Another classification operation may optionally take place first, so that any remaining larger parts can be separated out and returned to the raw stems, which are then fed back through the process described so far. If winnowings from cigarette production or tobacco production are used as the initial material in this process instead of raw stems, the process terminates as a rule before the first classification and the defibrated winnowings are fed directly into the end product.

Figure 2:
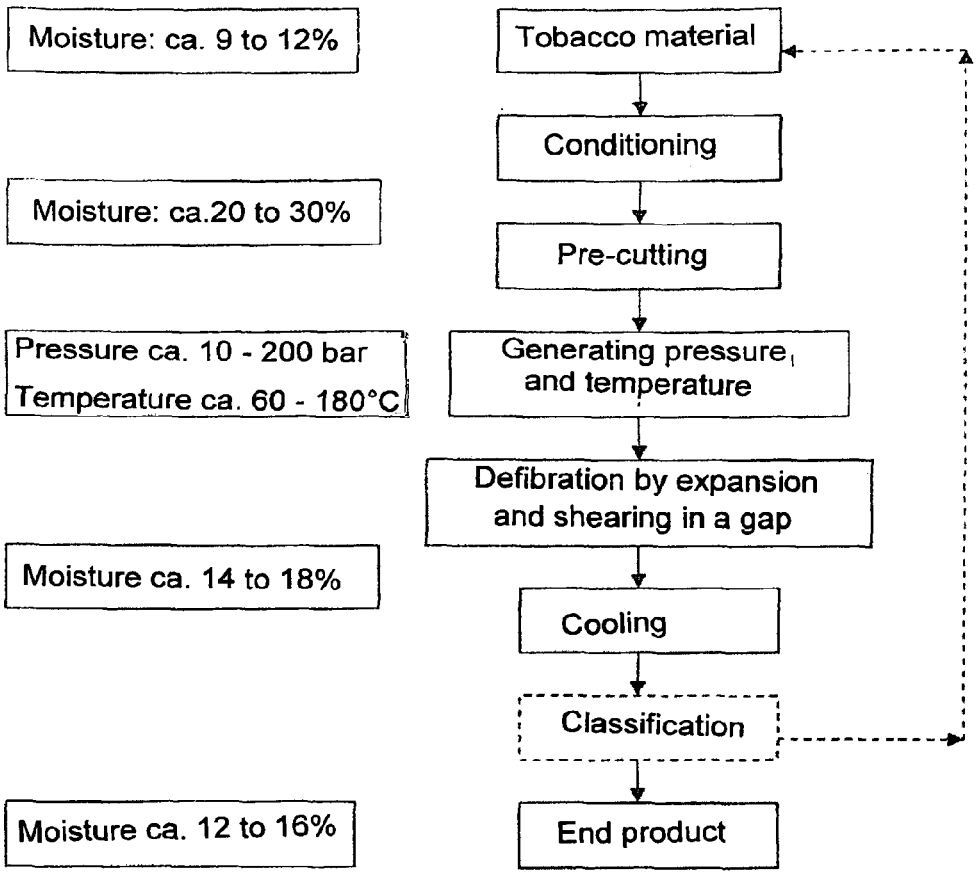
FIG. 2 is another flow chart showing the system in slightly more detail.

FIG. 2 specifically illustrates the sequence involved in the defibration process proposed by the invention and the process steps which follow immediately after in slightly more detail and with a with more narrowly limited or also slightly different moisture values. In this respect, it should be noted in principle that these values and the process parameters as a whole may always be selected and set by persons skilled in the art depending on the desired end product.

In FIG. 2, the first two method steps of FIG. 1 (conditioning, defibration, sifting) are combined in boxes. The tobacco material, in particular stem materials such as raw stems, winnowings, short stems and stem fibres for example, but also scraps (small leaf tobacco particles), other tobacco small pieces or also a mixture of the individually listed components are conditioned in the first process step and moistened to a degree of ca. 20% to 30% depending on the material. Moistening and optionally the addition of flavouring and casing may take place conventionally at atmospheric pressure with a short storage time or alternatively without a storage period and under pressure, as described in patent specifications DE 100 38 114 A1 and DE 103 04 629 A1 for example. If the stem material is of the coarser type, such as raw stems, short stems or stem fibres, the material may be pre-cut to particle sizes of between 2 and 15 mm, in which case it may also be partially defibrated at this stage, depending on the selected method. All standard methods may be used for pre-cutting. Whichever is used, however, dust and small parts should be avoided (smaller quantities of fines are tolerable). In the case of smaller starting materials, a pre-cutting operation can be totally dispensed with.

The material is then heated (ca. 60° to 180° C.) and placed under pressure (ca. 10 to 200 bar), on the one hand to obtain the desired improvement in flavour through chemically operated processes (e.g. Maillard reaction or caramelisation) and on the other hand to store enough energy to enable the defibration to take place by shearing and expansion through a shearing gap. The pressure generation and heating may be operated with standard plug screw feeders, the housings of which in particular may also be heated. Such systems will be described in more detail below.

On leaving the shearing gap and entering the atmosphere, the entrained water evaporates abruptly and optionally also other entrained ingredients, which, in addition to the shearing effect, causes the material to be defibrated and expanded in the gap. The moisture of the material is reduced to ca. 10% due to the flash evaporation, depending on the process pressure and temperature, and ingredients contained in the tobacco are also reduced to a certain extent. In this respect, it has proved to be of advantage if the shearing gap surfaces are moved relative to one another at a certain rate in order to prevent and clear blockages. This ensures that the full cross-sectional surface of the gap is used and constant physical conditions prevail at the gap, which ultimately results in a uniform product. To this end, it has also proved to be of advantage if the gap surfaces are structured or profiled.

During subsequent cooling of the material from ca. 100° C. to room temperature, which takes place on a conveyor belt on the basis of air suction and may be operated from underneath, the tobacco material loses more moisture due to cooling by evaporation thereby making it possible to arrive at the moisture level of the end product without a dryer, thereby enabling direct blending in the leaf tobacco mixture.

Whether a classification of the cut tobacco material and the associated return of too large particles is necessary will depend on the material to be cut and on the nature of the pre-cutting process. In the case of winnowings from cigarette production or with material of a similar size, no classification is necessary as a rule.

Instead of operating the pre-cutting process with a mill or breaker and generating the pressure and heating with a heated plug screw feeder, it may also be preferable to use a single or twin screw extruder because this enables the material to be pre-cut by shearing, simultaneously generating heat due to the friction and building up a corresponding pressure due to the compression of the screw. This therefore enables three of the necessary process steps to be combined in one device at the same time. This being the case, the extruder must be configured so that the material is not completely cut and plasticised (high density) as desired which is what otherwise usually happens with extrusion processes, but the fibre structure of the tobacco material is preserved. This means that the extrusion process should not be run in the classical sense.

All the intended objectives are achieved by the process proposed by the invention:

- flavour enhancement or sensory improvement;
- reduction of the CO/condensate ratio in the smoke (compared with other stem products, e.g. cut stem products);
- packing capacity similar to that of cut leaf tobacco depending on the initial material;
- visually imperceptible fibres similar to cut leaf tobacco;
- drastic shortening of storage times during moistening or no storage times during pressure conditioning;
- no dryer;
- high material yield (small parts less than 1 mm represent less than 10%); and
- compact overall process with correspondingly low space requirements and low capital investment and operating costs.

Figure 3:
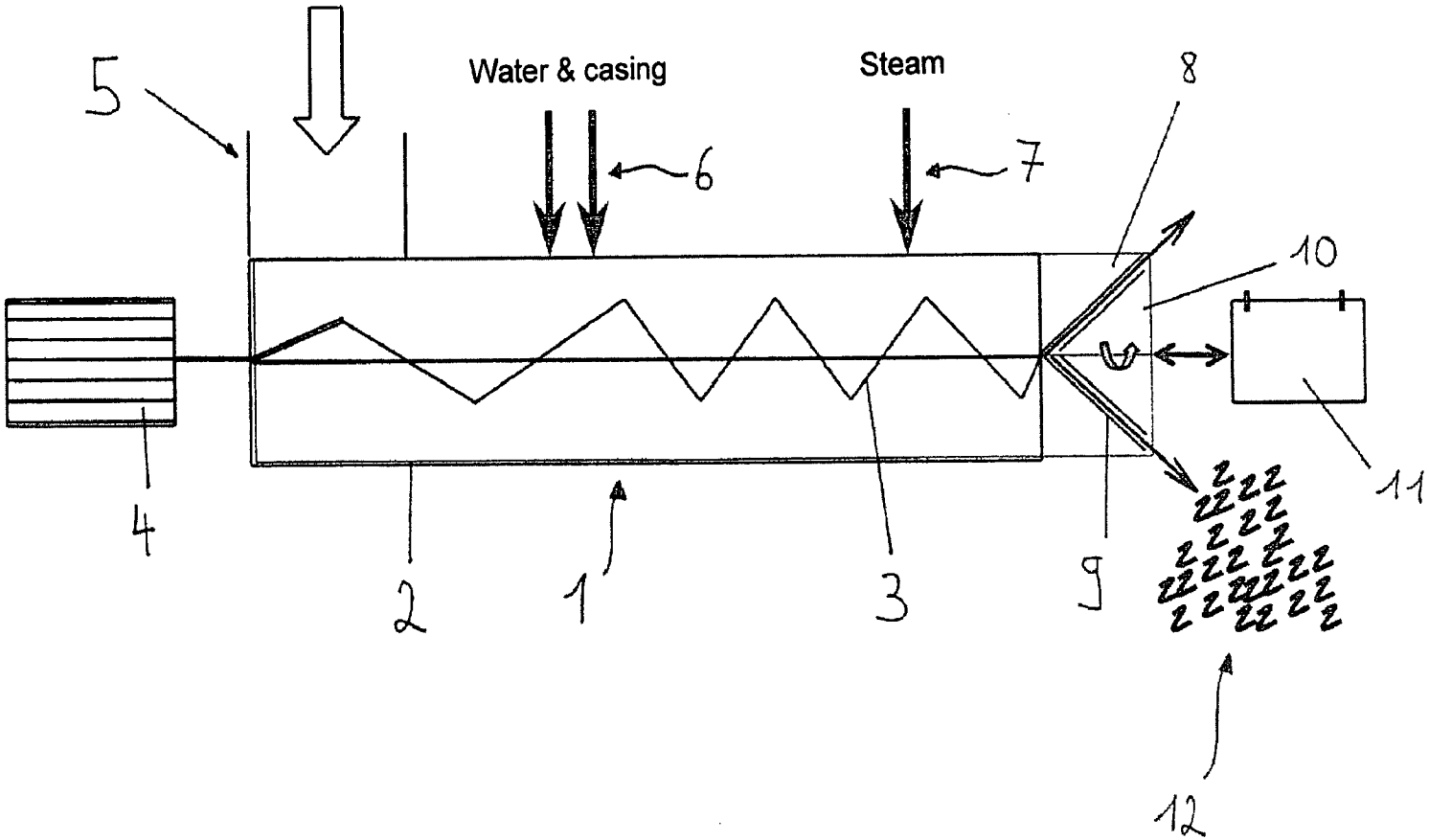
FIG. 3 shows an embodiment of a pressure defibrating device proposed by the invention.

An embodiment of the device proposed by the invention will now be described in more detail with reference to FIG. 3. It illustrates a pressure defibration device proposed by the invention denoted as a whole by reference number 1. It has a chamber housing 2 and disposed in it a conveyor screw 3, which is rotated by means of the motor 4. Also illustrated in the drawing of FIG. 3 is a tobacco material inlet 5 and optional inlets for water, casing (and/or flavouring) and steam, denoted by reference numbers 6 and 7. At the outlet end (on the right in the drawing) the chamber has a head 8, which forms an inner cone. The inner cone wall of the head 8 in conjunction with the outer cone wall of the outer cone 10 form the gap 9 through which the tobacco material conveyed by the screw 3 can be discharged. Disposed at the gap apex of the inner cone 8 is an orifice leading to the interior of the chamber 2. The discharged, defibrated tobacco material is denoted by reference number 12.

The outer cone 10 is positioned by means of a co-operating holder 11, which may simultaneously constitute a rotary drive for the conical body 10. The cone 10 can be rotated about the central axis indicated by the bent arrow by means of this rotary drive. The connection between the co-operating holder 11 and the cone 10 is indicated by a double arrow, which means that the cone 10 can be moved towards the inner cone 8 along the axis. There, it can be securely retained in its axial position, but may also be disposed so that it can move axially. As a result of this construction, the width of the gap can be adjusted or adapted and a counter-pressure can also be generated towards the left, in other words in the direction of the closure of the gap 9, preferably by hydraulic means.

The first part of the process of defibrating the tobacco stems as proposed by the invention takes place at a pressure above atmospheric pressure. This over pressure is generated as the tobacco material, in the special case of conditioned tobacco stems, is conveyed in the chamber 2 through the screw 3 once it has been introduced through the inlet 5. Disposed at the end of the conveyor screw is a shearing gap outlet, which virtually closes off the conveyor chamber in the same way as an extruder. As illustrated in FIG. 3, this die outlet is preferably provided in the form of an annular gap, namely as a cone gap 9, the gap width of which can be set by means of the outer cone 10 (punch). As a result, the stems are subjected to increased pressure (of up to 200 bar) and increased temperature (in particular significantly above 100° C.). In addition to the mechanical pressure which occurs due to the stems being conveyed towards this gap, additional forces also act on the stems because shearing forces act in the pitches of the conveyor screw in conjunction with the walls which cause the stems to be pre-cut and pre-defibrated. The shearing effect can be assisted by introducing draughts through housing wall or by introducing additional flow resistances. In addition, steam may be introduced at several points in order to regulate the moisture, the temperature and the pressure in the conveyor screw or in the housing 2. As a result of introducing steam (as illustrated in FIG. 7, for example) and due to the natural moisture of the stems from the conditioning process, additional defibration of the stems takes place on leaving the gap 9 because the water evaporates abruptly: the second part of the defibration process. Being under pressure, the moisture in the stems evaporates abruptly as the pressure drops to atmospheric pressure downstream of the annular gap; flash evaporation occurs.

The link between the conditioning and pressure defibration processes depends on the pressure conditions under which conditioning takes place. In the simplest situation, the tobacco material is simply conditioned under atmospheric conditions and is fed by means of conveyor chutes or a conveyor belt into the inlet 5, for example a hopper. The conditioning process may take place at an intermediate point of the housing 2 by introducing water and casing, as highlighted by reference number 6.

The decisive step of the defibration process takes place on passing through and leaving the gap 9. As they pass through the gap 9, the tobacco stems are subjected to shearing between the gap walls and the flash evaporation mentioned above takes place on leaving the gap. These co-operating effects result in the well defibrated process product, at least a large proportion of which can already be used to produce the smoking article.

In order to prevent blockages from occurring in the narrow shearing gap 9 across a large region of the annular surface or conical surface, which then detach abruptly, it has proved helpful if the cone 10 is kept in rotation about its rotation axis. This rotation may be continuous or intermittent or the direction of rotation may be alternated. This being the case, the rotation may be a full rotation or only a quarter or one third rotation or rotations of smaller/larger units.

It has also proved to be of advantage if the surface of at least one of the cones, the inner cone at the head 8 or the outer cone in the punch 10 is roughened or profiled, e.g. in the form of grooves or intersecting grooves recessed to a depth of up to 2 or 3 mm. The only important thing in this respect is that the roughening/profiling is provided and the depth and extension (direction) of the grooves may be disposed in any manner. It is more especially by rotating the cone 10 that blockages can be significantly reduced. The result is more homogeneous pressure conditions, which in turn leads to a more homogeneous end product.

The resultant, defibrated process product exhibits similar properties to those of stems processed by shredders in terms of appearance and use. However, the pressure defibration process proposed by the invention does not have the disadvantage of causing a lot of dust, as is the case when stems are processed by shredders, and moistening is not necessary to such a high degree, which enables subsequent drying to be significantly reduced or dispensed with.

Figure 4:
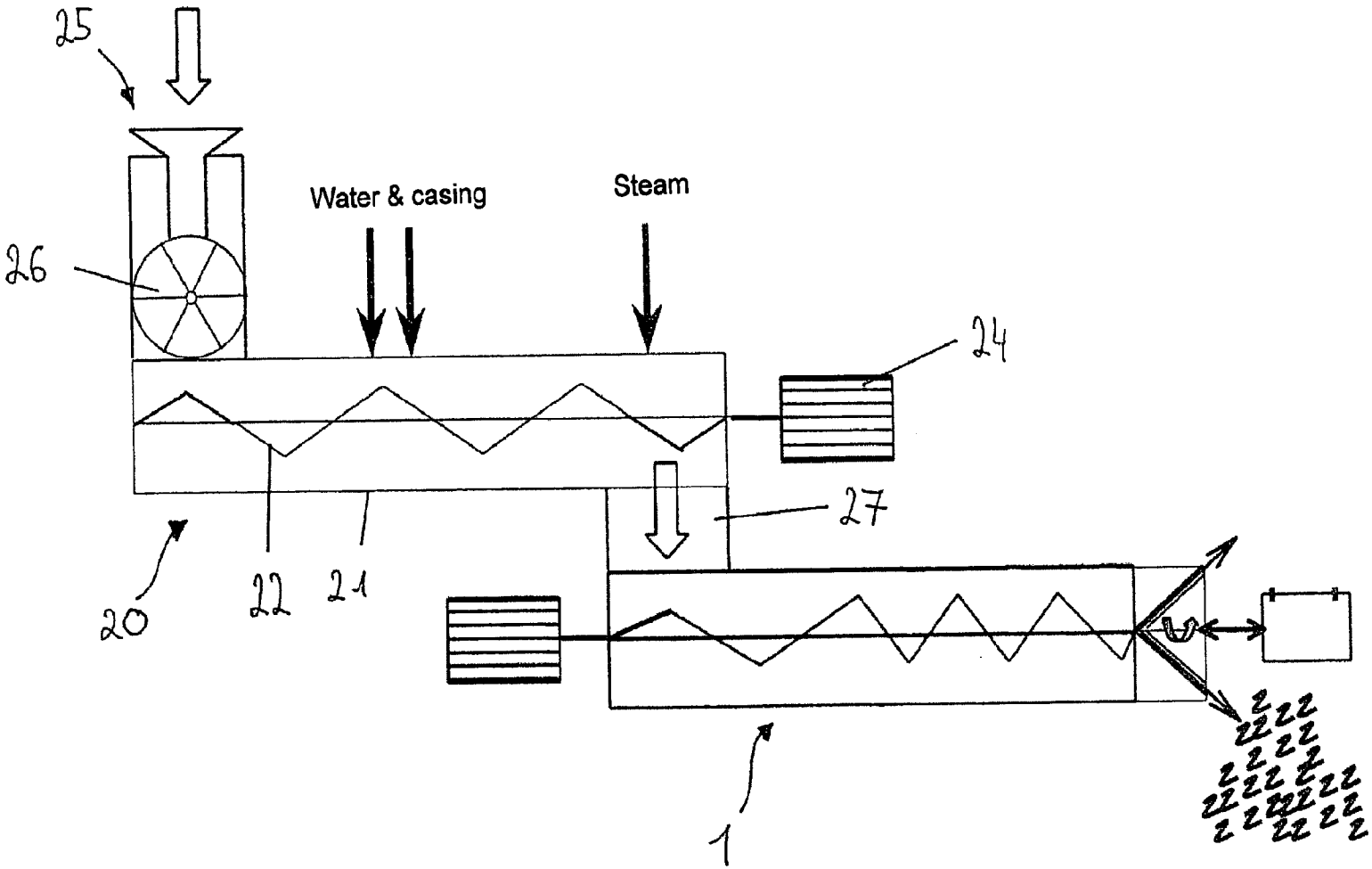
FIG. 4 illustrates a pressure defibrating device proposed by the invention with a first embodiment of a pressure conditioning system connected upstream.

As far as the linked or combined conditioning and pressure defibration processes are concerned, the present invention offers yet other possibilities, which will now be explained with reference to FIGS. 4 and 5. In FIG. 4 a pressure conditioning device 20 is connected upstream of and offset from the pressure defibration device proposed by the invention. The pressure conditioning device 20 is generally one of the type illustrated in particular in FIG. 1 of patent specification DE 103 04 629 A1 and described in the associated part of the description. The latter is included herein by way of reference. It has a tobacco material inlet 25 and a differential pressure-proof cellular wheel sluice 26 through which the tobacco material is introduced into the pressure chamber 21, where it is transported with the aid of a conveyor screw 22. The conveyor screw 22 is driven by a motor 24. Disposed at the end of the chamber 21 is an outlet 27 for the tobacco material, which simultaneously constitutes the inlet for the pressure defibration device 1. Unlike the device described in patent specification DE 103 04 629 A1, there is no differential pressure-proof sluice at the outlet of the pressure conditioning device; the tobacco material is transferred to the inlet of the pressure defibration device 1 by the pressure of the chamber 22.

Within the scope of the present invention, it would naturally also be possible to operate the outlet from the pressure conditioning chamber 22 using a cellular wheel sluice and decrease the pressure. In this case, the tobacco material would be transferred to the pressure defibration process at ambient pressure, as illustrated in FIG. 3.

However, it is preferable to avoid a drop in pressure during the transfer from the pressure conditioning process to the pressure defibration process to enable an above atmospheric pressure to be applied across the entire processing region from the start of conditioning through to the defibration process, as illustrated in FIG. 4. The entire plant in FIG. 4 corresponds to the "conditioning (and casing)/defibration" box in FIG. 1. The stems are fed through the differential pressure-proof cellular wheel sluice 26. The pressure-proofing of the sluice 26 at one end and the narrow annular gap 9 which is always filled with defibrated stems during operation make it possible to maintain a pressure above atmospheric pressure throughout the combined device. To this end, sealing of the cellular wheel sluice 26 may be optimised by heating its housing.

Once the tobacco stems have been introduced into the chamber 22, the stems are at a pressure above atmospheric pressure, which is maintained by introducing steam to compensate for the natural leakage rates of the cellular wheel sluice 26 (gaps and spillage volumes). The stems are heated by the steam and the moisture content increased. In principle, it would also be possible to operate a drying process in such a chamber using over-saturated steam, but when used for defibration, it is usually of advantage if the stems introduced have significantly higher moisture contents. The tobacco stems are conveyed through the conditioning chamber 22 by the conveyor screw 22. Different settings may be used for this purpose (pitch of the screw, rotation speed and inclination of the chamber), by means of which the dwell time of the tobacco stems can be set. As a rule, it is between 2 and 10 minutes. After the pressure conditioning process, during which water, casing and/or flavouring material may also be added, the stems are then transferred through the outlet 27 into the pressure defibration device 1 and the process of introducing them may also be made simple if the housing is also of a hopper-type design. The typical dwell time of the stems in the region of the defibration process is less than 2 minutes, in particular less than 1 minute. The stems then leave the pressure defibration process in the desired state described above.

Instead of the pressure conditioning screw, it would also be possible to use a conditioning screw at below atmospheric pressures.

Figure 5:
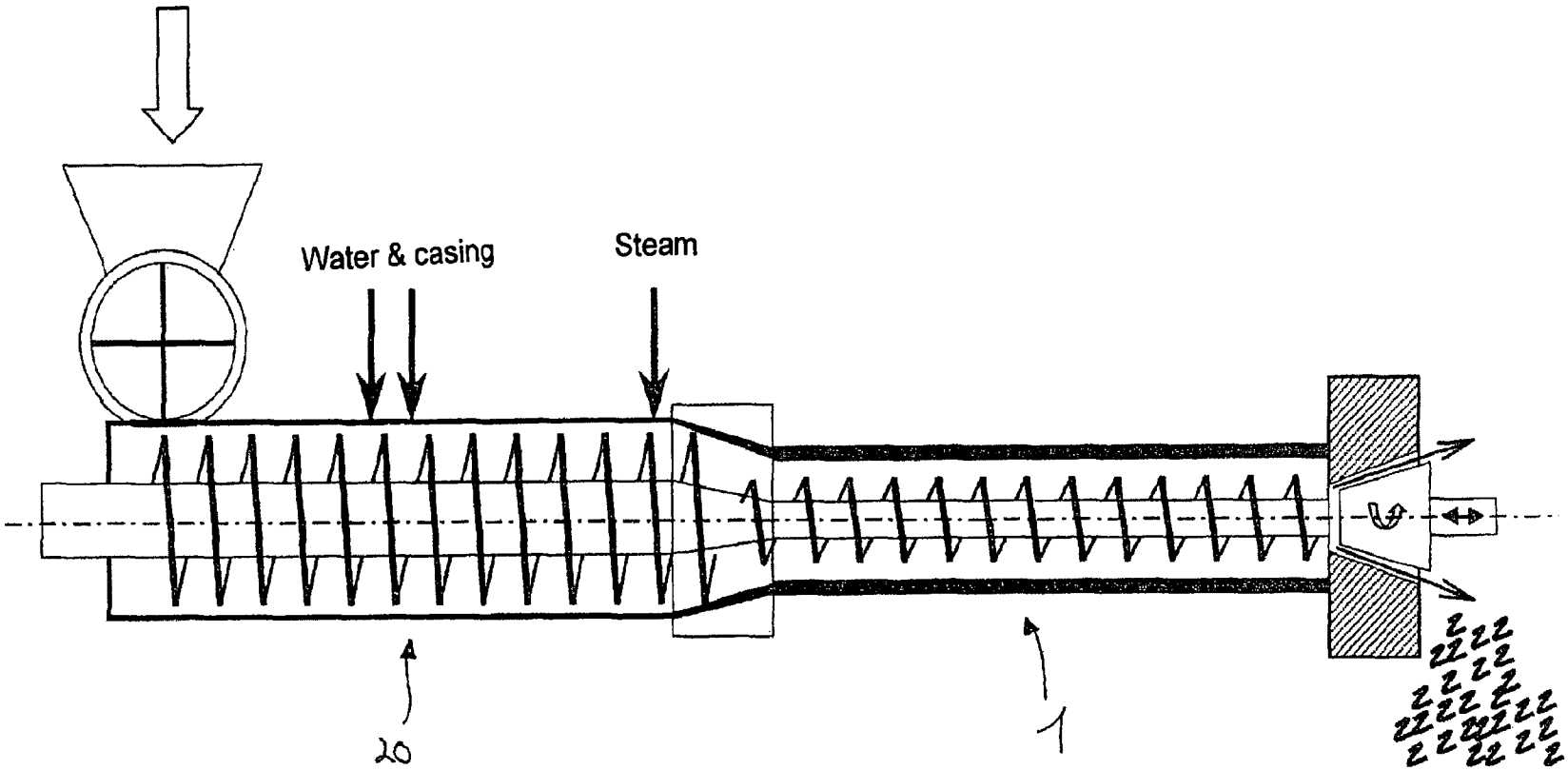
FIG. 5 shows a second embodiment based on a combined pressure conditioning-pressure defibration device.

FIG. 5 illustrates another embodiment of a plant with a combined pressure conditioning and pressure defibration system. The pressure conditioning device 20 and the pressure defibration device 1 are essentially of the configuration illustrated in FIGS. 3 and 4 and there is therefore no need to describe the individual components. The difference compared with the embodiment illustrated in FIG. 4 resides in the fact that the conveyor screw of the conditioning device 20 and the defibration screw of the pressure defibration device 1 sit on one and the same shaft and can be driven by a single motor. If the same rotation speed is used for both screws, the different dwell times in the two process steps may be obtained using different means, e.g. by different cross-sections/volumes, release options in the region of the conditioning process, etc.

In the situations illustrated in FIGS. 4 and 5, the conditioning agents and the steam are introduced through the appropriate inlet options which already exist on the pressure conditioning device and it is therefore not necessary to provide corresponding facilities on the pressure defibration device. In particular, flavouring and/or casing can be introduced in both pressure ranges, i.e. in one of the pressure chambers, or at atmospheric pressure, i.e. outside of the chambers.

The invention claimed is:

1. A method of producing cut tobacco material comprising:

providing an initial tobacco material;

heating said initial tobacco material and placing it under pressure;

feeding said initial tobacco material, which has been heated and placed under pressure, through a shearing gap; said shearing gap having walls which can be moved relatively towards and away from one another and at least one of said walls being roughened on its surface facing the other wall; and one said wall being rotatable relative to the other said wall, adjusting the spacing between said walls to open to a predetermined value; and rotating one said wall as said initial tobacco material is fed through said shearing gap whereby said initial tobacco material is cut and defibrated.

2. The method as claimed in claim 1, in which said initial tobacco material is predominantly a coarse tobacco material, in particular with a particle size of more than 2 mm.

3. The method as claimed in claim 1, in which said initial tobacco material is a tobacco stem material, in particular with a stem size of more than 2 mm.

4. The method as claimed in claim 1, in which said initial tobacco material is a winnowing material.

5. The method as claimed in claim 1, which is implemented using said initial tobacco material without adding structure-imparting materials.

6. The method as claimed in claim 1, whereby said initial tobacco material is heated to a temperature of 60 to 180° C., and brought to a pressure of 10 to 200 bar, and the dwell time of said initial tobacco material during continuous circulation through the process is less than 3 minutes.

7. The method as claimed in claim 1, whereby said initial tobacco material is mechanically placed under pressure by being mechanically pressed against said shearing gap in the outlet of a chamber at which said shearing gap is disposed.

8. The method as claimed in claim 7, whereby said initial tobacco material is placed under pressure by means of a conveyor screw which presses said initial tobacco material against the outlet end of the chamber of a heatable screw conveyor at which said shearing gap is disposed.

9. The method as claimed in claim 7, whereby said initial tobacco material is coarsely pre-cut or coarsely defibrated in said chamber in said heatable screw conveyor as said initial tobacco material is transported towards said shearing gap.

10. The method as claimed in claim 1, whereby said shearing gap is closed under pre-tensioning and is opened by the pressure of said initial tobacco material as said initial tobacco material passes through the said shearing gap.

11. The method as claimed in claim 1, whereby said initial tobacco material is fed through a continuously opened shearing gap.

12. The method as claimed in claim 1, whereby said shearing gap walls are able to effect a relative movement as said initial tobacco material is fed through.

13. The method as claimed in claim 1, whereby said initial tobacco material is allowed to expand to atmospheric pressure as it passes through said shearing gap.

14. The method as claimed in claim 13, in which said initial tobacco material has a moisture content adjusted to approximately 14 to 42% as a result of expansion and passing through said shearing gap.

15. The method as claimed in claim 14 wherein said initial tobacco material has a moisture content adjusted to approximately 16 to 18% as a result of expansion and passing through said shearing gap.

16. The method as claimed in claim 1, whereby said initial tobacco material, before or during heating and being placed under pressure, is subjected to a conditioning process during which a casing and/or a flavouring may be added which results in an increase in said initial tobacco material moisture content from approximately 9 to 12% to approximately 18 to 45%.

17. The method as claimed in claim 16, in which said initial tobacco material moisture content is increased to approximately 20 to 30%.

18. The method as claimed in claim 1, whereby said initial tobacco material is cooled at room temperature and under atmospheric pressure after it has passed through said shearing gap until it has a moisture content of approximately 12 to 16%.

19. The method as claimed in claim 1, whereby the cut and defibrated initial tobacco material is forwarded directly for further processing as a smoking article material if the said initial tobacco material is a winnowing material.

20. The method as claimed in claim 1 whereby said initial tobacco material is heated to a temperature of 100 to 140° C., brought to a pressure of 40-150 bar, and the dwell time of said initial tobacco material during continuous circulation through the process is less than 2 minutes.

21. The method as claimed in claim 1 wherein said initial tobacco material is heated to a temperature of 110 to 130° C., brought to a pressure of 60-120 bar, and the dwell time of said initial tobacco material during continuous circulation through the process is less than 1 minute.

22. The method as claimed in claim 1 whereby the cut and defibrated initial tobacco material is subjected to a classification if said initial tobacco material is a coarse stem material, and the materials separated out during said classification are then subjected to the said method again, and the rest which is not separated out is forwarded directly for further processing as a smoking article material.

* * * * *